US010137459B2

(12) United States Patent
Guthrie

(10) Patent No.: US 10,137,459 B2
(45) Date of Patent: Nov. 27, 2018

(54) ION GENERATOR DEVICE

(71) Applicant: NATURION PTE. LTD., Bukit, Merah Central (SG)

(72) Inventor: Warren Edwin Guthrie, West Olive, MI (US)

(73) Assignee: Naturion PTE. LTD., Bukit Merah Central (SG)

( * ) Notice: Subject to any disclaimer, the term of this patent is extended or adjusted under 35 U.S.C. 154(b) by 4 days.

(21) Appl. No.: 15/403,774

(22) Filed: Jan. 11, 2017

(65) Prior Publication Data

US 2017/0197219 A1 Jul. 13, 2017

Related U.S. Application Data

(60) Provisional application No. 62/277,739, filed on Jan. 12, 2016.

(51) Int. Cl.

| | |
|---|---|
| ***B03C 3/41*** | (2006.01) |
| ***B03C 3/04*** | (2006.01) |
| ***H01T 23/00*** | (2006.01) |

(52) U.S. Cl.

CPC ..... *B03C 3/41* (2013.01); *B03C 3/04* (2013.01); *H01T 23/00* (2013.01)

(58) Field of Classification Search

CPC ..... B03C 3/04; B03C 3/41

See application file for complete search history.

(56) References Cited

U.S. PATENT DOCUMENTS

| | | | | |
|---|---|---|---|---|
| 3,898,468 | A | 8/1975 | Guerin | |
| 4,064,548 | A | 12/1977 | Best et al. | |
| 6,176,977 | B1 | 1/2001 | Taylor et al. | |
| 6,785,114 | B2 | 8/2004 | Gorczyca et al. | |
| 6,974,560 | B2 | 12/2005 | Taylor et al. | |
| 7,291,207 | B2 | 11/2007 | Taylor et al. | |
| 7,897,118 | B2 | 3/2011 | Taylor et al. | |
| 2008/0074824 | A1* | 3/2008 | Furuhashi | A61L 9/22 361/231 |
| 2012/0269677 | A1* | 10/2012 | Zhou | A61L 9/22 422/4 |
| 2014/0301009 | A1 | 10/2014 | Ogawa | |

FOREIGN PATENT DOCUMENTS

| | | | |
|---|---|---|---|
| WO | 2014002960 | A1 | 1/2014 |

OTHER PUBLICATIONS

Rafael Marti Almeda, European Search Report, dated May 24, 2017, 7 pages, European Patent Office, Munich Germany.

Rafael Marti Almeda, European Office Action—Communication pursuant to Articl e94(3) EPC, dated Mar. 5, 2018, 4 pages, European Patent Office, Netherlands.

* cited by examiner

*Primary Examiner* — Kevin Joyner

(74) *Attorney, Agent, or Firm* — McGarry Bair PC

(57) ABSTRACT

An ion generating device can include a housing with at least one conductive surface and an opening, an anode and a cathode disposed within the housing and having a space between them in fluid communication with the opening, a power source having a negative terminal and a positive terminal with a first connection between the negative terminal and the anode and a second connection between the positive terminal and the cathode, and an air mover disposed to move air through the space.

9 Claims, 6 Drawing Sheets

ION GENERATOR DEVICE

CROSS-REFERENCE TO RELATED APPLICATION(S)

This claims the benefit of U.S. Provisional Application No. 62/277,739, filed Jan. 12, 2016, which is incorporated herein by reference in its entirety.

BACKGROUND OF THE INVENTION

Negative air ion generation can be used as a means to clean air. The theory of operation is electrons are added to air molecules (i.e. "generating ions") by applying an electric field to spaced surfaces, generating negatively charged air particles passing between the spaced surfaces. These negatively charged particles bond to air-borne pollutants suspended in environmental or ambient air and subsequently move or are drawn to positively charged surfaces like walls and floors. The overall process moves pollutants from the air in a defined space to other places (e.g. walls and floors) that can be easily cleaned with traditional methods.

BRIEF DESCRIPTION OF THE INVENTION

In one aspect, the present disclosure relates to an ion generating device including a housing with at least one conductive surface and an opening, an anode and a cathode disposed within the housing and having a space between them in fluid communication with the opening, a power source having a negative terminal and a positive terminal with a first connection between the negative terminal and the anode and a second connection between the positive terminal and the cathode, an air mover disposed to move air through the space, and a resistive element connected to the second connection and associated with the at least one conductive surface wherein when the power source is energized, an electrical field with negative ions is generated in the space and the negative ions are moved through the opening by the air mover with minimal charge build up.

DESCRIPTION OF EMBODIMENTS OF THE INVENTION

Figure 1:
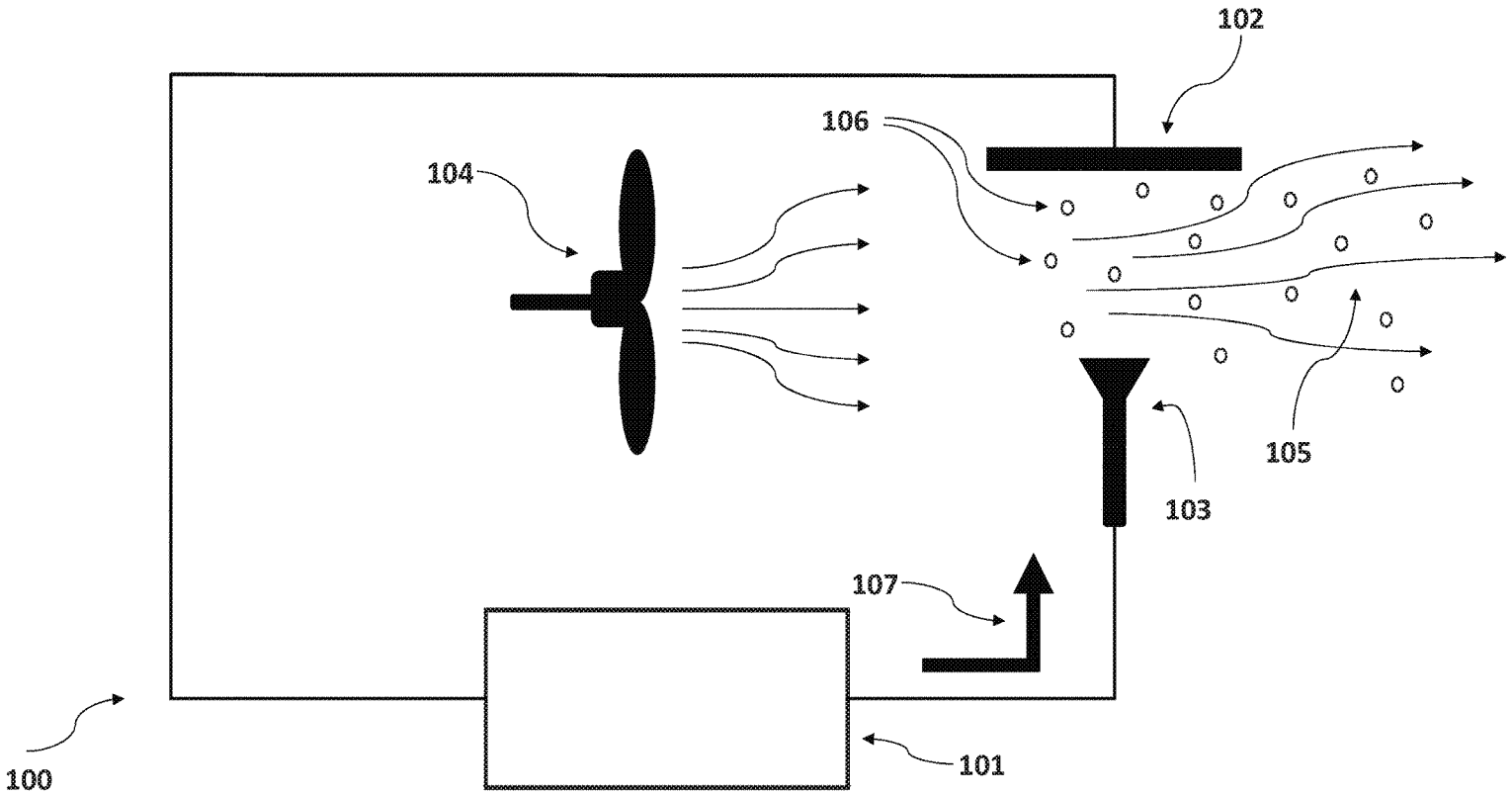
FIG. 1 shows a schematic drawing of a device for injecting ions into a stream of air, in accordance with various aspects described herein.

Aspects of the disclosure relate broadly to a device and method for injecting ions into a stream of air, in particular negative ions. The device, method, or process including aspects of the disclosure can consist of projecting a stream of electrons that are attached to air molecules, and thus, results in a current flow from the ion generator into the room. If any factor reduces the electron flow, then the device, method, or process has reduced effectiveness or fewer electrons or ions. Aspects of the disclosure can include methods or apparatus to overcome factors that reduce current flow in air ion generators. In another aspect, the disclosure relates to a device and method for injecting ions into a stream of air for providing a stable production of ions, and can improve the flow of ions (electrons) into a desired space or environment.

As used herein, a "defined space" refers to a region that contains the ion generator and is separated from a larger space by a partition. For example, a bedroom, hospital room, or vehicle interior. While "a set of" various elements will be described, it will be understood that "a set" can include any number of the respective elements, including only one element. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to each other. In non-limiting examples, connections or disconnections can be selectively configured to provide, enable, disable, or the like, an electrical connection between respective elements. The exemplary drawings are for purposes of illustration only and the dimensions, positions, order and relative sizes reflected in the drawings attached hereto can vary.

Generally, at least two factors can reduce ion generation current flow into the room. The first factor can include that the negative ion generation process can cause surfaces of the ion generator to become negatively charged and, as such, will tend to repel like-charged particles, including negative air ions. The term for this phenomena is "charge build-up." The result is lower electron flow the longer the ion generator operates.

The second factor can include that current must flow through a closed path. In the case of an air ion generator, such as aspects disclosed herein, the closed path can includes the air in the space around the generator or between the spaced conductive surfaces, such as an anode element and a cathode element. As such, the range that ions are projected will naturally only include the current return path. If the return path does not include surfaces surrounding the defined space, then, even though ions might be produced, they are not projected into the intended space. The term for this phenomena is "ion confinement."

Aspects of the disclosure can include reducing the effects of charge build-up on surfaces of the ion generator, especially those nearby the ion source by treating at least one surface with conductive material. The surface treated with conductive material can provide an electrical path to remove the negative charge so that negative charge does not collect on the surface and subsequently repel the ions. The conductive material can include an electrically conductive path to, for example, the positive terminal (also referred to as the "cathode") of the associated electron current source.

In one example aspect of the disclosure, to reduce the effects of ion confinement, the electron's source return path can be electrically coupled to an electrical ground, including, in one non-limiting example, building wiring. For example, using building wiring for a ground connection for the uses of air ionizers, can be utilized wherein no direct Earth grounding is provided, or wherein the user is unlikely to adapt the building to use the product. In aspects of the disclosure, the current path can be provided with a connection of the electron source to building wiring. The connection is most effective when the means includes the building's Earth ground (for instance, the 'green wire') because many common features in buildings are connected to Earth such as conduits, water pipes, floors, foundations etc. However, in many instances, Earth ground is not available to the ion generator. In this case, an alternative or additional means is to provide a connection through a resistive path to building wiring. The connection to the building wiring provides a convenient and effective method of providing a path that is less directly connected to building features, but nonetheless highly effective compared to providing no current return path. Connection to building wiring usually provides a sufficient yet ad-hoc return path for current and is appropriate for situations where the cost of adding an intentional return path is not warranted.

To reduce the effects of ion confinement, there is another configuration for embodiments of the disclosure, which provides a current path by adding, applying, or layering at least one conductive surface to the defined space which can be further electrically connected to the electron source. This method is appropriate in situations where the cost is justifiable such as an industrial or medical application. For example, a hospital room might include a conductive floor or a livestock barn might include a conductive screen on one or more walls.

FIG. 1 shows an ion generating device 100 for injecting ions into a stream of air 105. The device uses a power source 101, such as a high voltage generator or source connected to a cathode 102 and anode 103. Electrons 107 flow (illustrated as an arrow) from the power source 101. Negative ions 106 are produced or generated in the region between the anode 103 and cathode 102. A fan 104 can blow or direct the ions 106 contained in a stream of air 105 or along a flow path 105.

Figure 2:
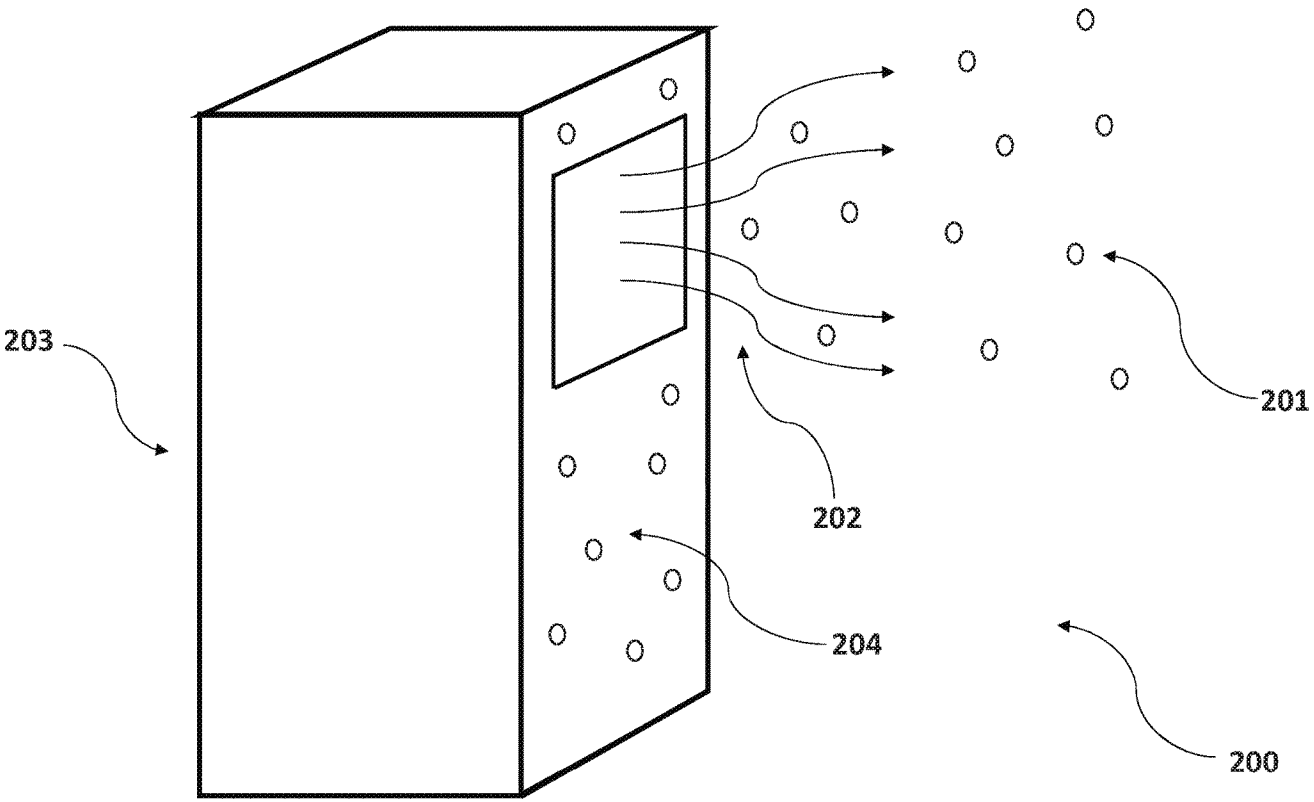
FIG. 2 shows an outer view of a device for injecting ions into a stream of air, emphasizing charge build-up, in accordance with various aspects described herein.

FIG. 2 shows a perspective view of an ion generating device 200 having a housing 203, according to another aspect. The ion generating device 200 operates similar to the device 100 illustrated in FIG. 1, by injecting ions 201 into a stream of air 202. The device includes the housing 203, illustrating a charge build-up 204 on the surface.

Figure 3:
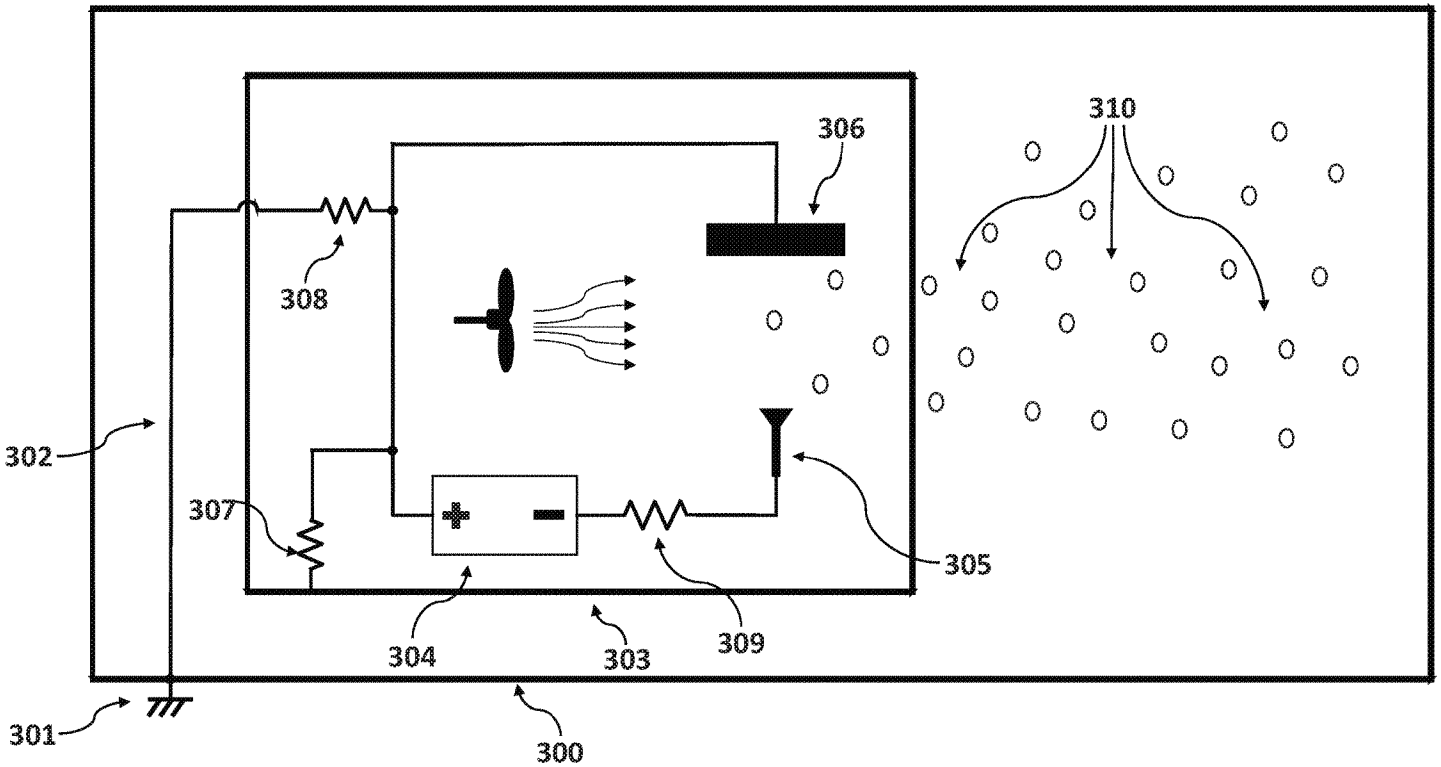
FIG. 3 shows a schematic circuit diagram of the electric circuits in accordance with various aspects described herein.

FIG. 3 shows a schematic diagram that includes an ion generating device according to aspects of the disclosure for improving ion consistency. A defined space 300, such as a room, a car, or an enclosed volume, can include at least one electrical connection to an electrical ground 301, which can include in one non-limiting example Earth ground. The electrical ground 301 connection is further electrically connected by wire 302 to the ion generator 303 through resistor 307, which connects to at least one surface of the ion generator 303. The surfaces of the ion generator 303 can include a cathode 306 and a spaced anode 305. The cathode 306 is also connected though a resistor 308 to ground 301. A power source 304, such as a high voltage generator, is connected through a current-limiting resistive element 309, such as a protection resistor, to the anode 305. The current-limiting resistive element 309 can be selected to provide protection for inadvertent human contact to the anode. The coupling of the power source 304 to the cathode 306 and anode 305 creates an electric field between the cathode 306 and anode 305. The electric field, in turn, generates or produces a set of negative ions 310 in the ambient air occupying or traversing the electric field. The negative ions 310 proceed into the ambient space 300 because they are attracted to the higher voltage potential of the materials defining the space, such as the wall or floor, as previously described. As shown, the materials defining the space can have a higher voltage potential because they are connected to the electrical ground 301.

Figure 4:
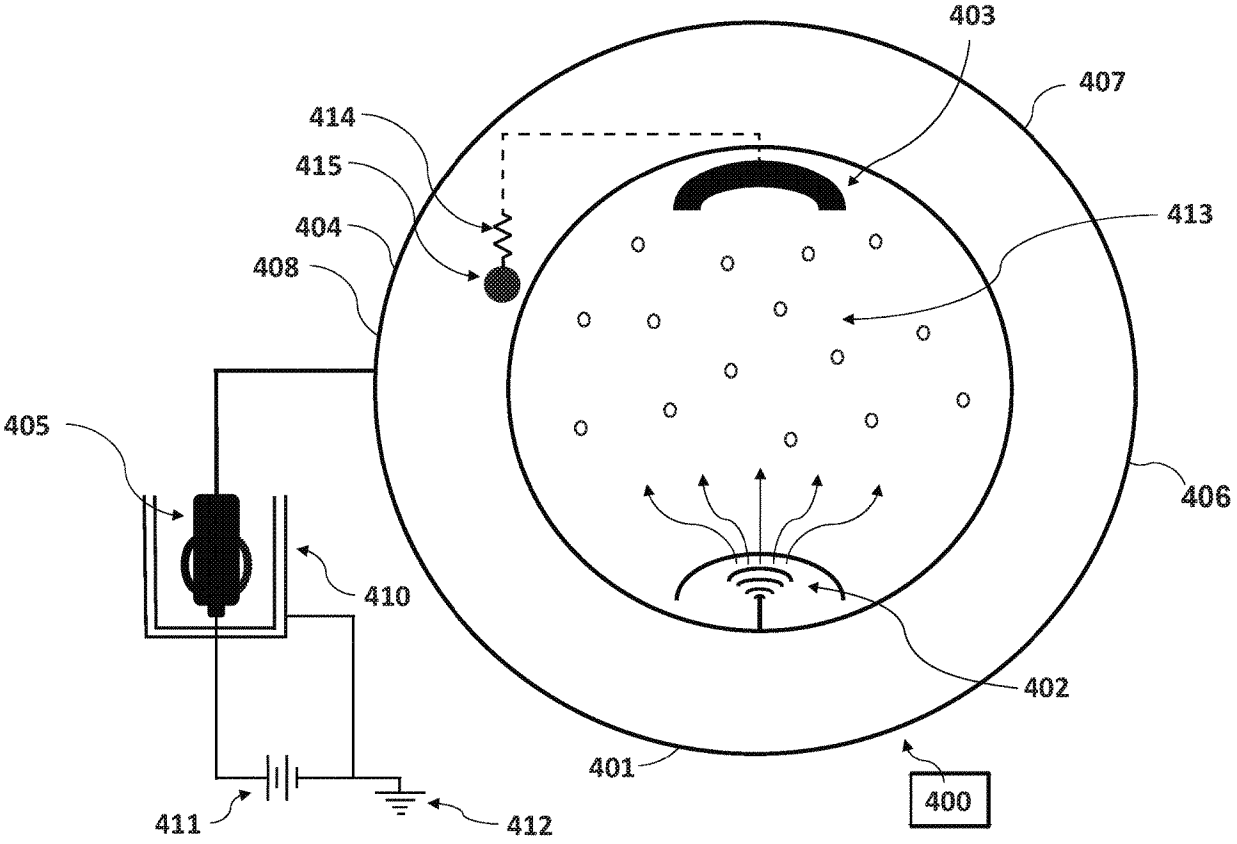
FIG. 4 shows a circuit diagram for use in a vehicle, in accordance with various aspects described herein.

FIG. 4 diagrams another aspect of the disclosure configured for use as an ion generating device 400 for application to a vehicle, such as an automobile. While an automobile is described, embodiments of the disclosure can be equally applicable in aircraft or aqueous-based vehicles, wherein a volume of ambient air can be occupied with negative ions. As previously described, a power source 406, such as a high voltage generator is connected to cathode 403 and anode 402 through a protection resistor 401. Ions 413 are produced in the region between cathode 403 and anode 402. A power connection 405 is provided through a power socket 410 to energize the power source 406, which for example can supply power from a battery 411 located in the vehicle. As such, the vehicle ground 412 is connected to the device through internal circuitry 408 and a connection 404 to the cathode 403. A conductive surface 407 is provided to mitigate charge buildup by connection 415 through resistor 414.

Figure 5:
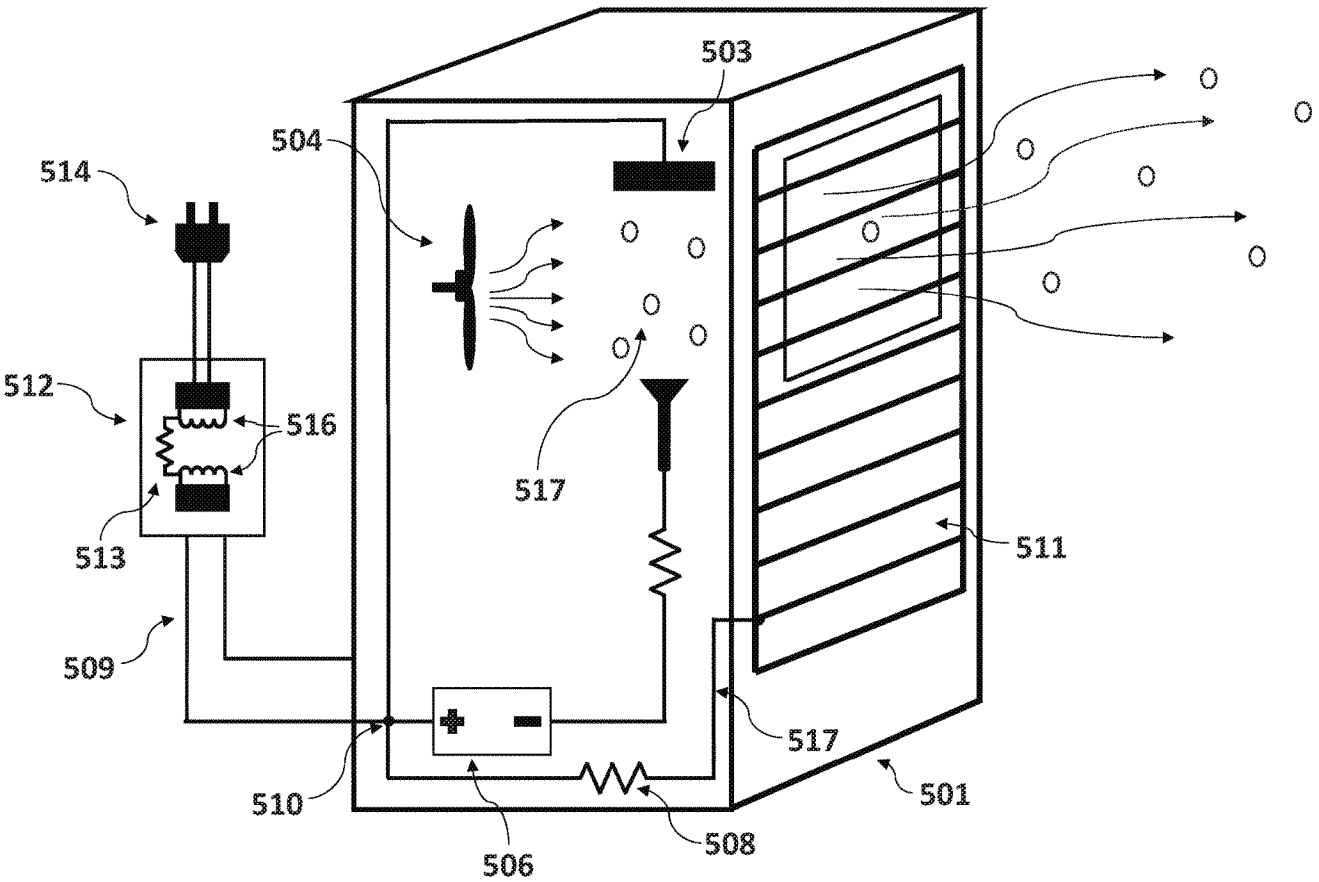
FIG. 5 shows a circuit diagram for use with an external transformer-isolated power supply, in accordance with various aspects described herein.

FIG. 5 shows an ion producing device 501 according to yet another aspect of the disclosure, including air stream 504 and ions 517. The ion generating device 501 can use an external power supply 512. In many cases, external power supplies provide ground isolation through a transformer 516. As such, a bridging resistor 513 provides a high resistance path that will still allow sufficient current flow as a counter measure to ion confinement. The diagram shows a connection 510 from the positive terminal of the power supply 506, such as a high voltage supply through the power supply leads 509 through the bridge resistor 513 to building wiring connection 514. Additionally, a connection 510 is provided to at least one selected outer surface 511 or to at least one inner surface 517 is provided by resistor 508. The ion producing device 501 can further include a cathode 503, as shown.

Figure 6:
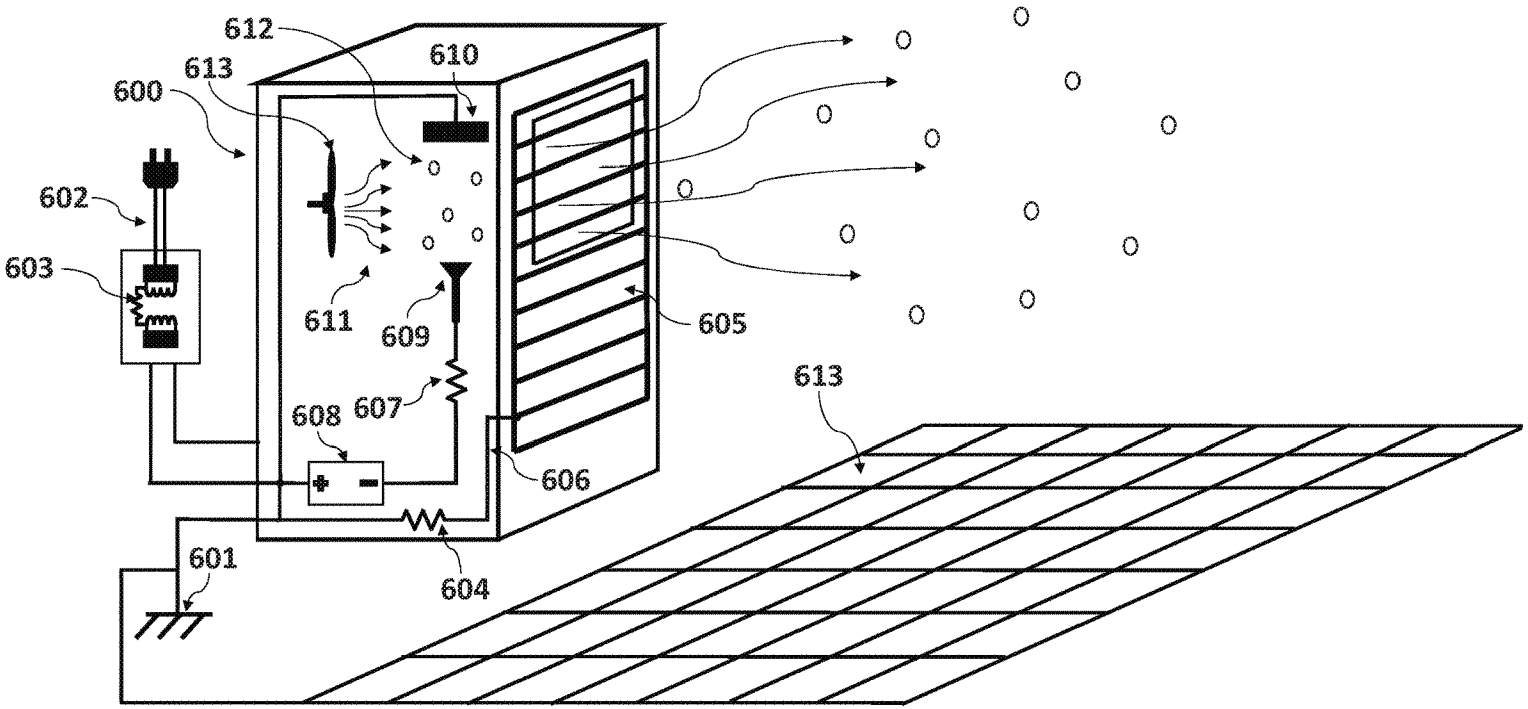
FIG. 6 shows a circuit diagram for use with an internal power supply, in accordance with various aspects described herein.

FIG. 6 shows yet another aspect of the disclosure having an ion producing device 600, producing ions 612 in a region between cathode 610 and anode 609. The anode 609 is connected to power supply 608, such as a high voltage power supply through a safety resistor 607. A fan 613 produces an air stream 611 to propel ions 612 from the volume between the spaced cathode 610 and anode 609 to the ambient space outside of the device 600. The device 600 can be configured to use a power supply 603, 608 electrically supported by, for example, mains power 602, such as a wall outlet. The power supply 602, 603, 608 can be internal or external to the device 600. In this example, electrical ground 601 is connected to the positive terminal of the power supply 608. The electrical ground 601 is also connect to at least one selected outer surface 605 or at least one selected inner surface 606 of the device 600. Optionally, a grounded grid or plate 613 is included to provide an external ion path as might be used in livestock barns or hospital rooms.

As previously described, charge buildup can result in ions being repelled from production to the exit point. By selectively coating the surfaces in the ion path, including but not limited to the inner surface 517, 606 or outer surface 511, 605, and connecting these to the cathode 102, 306, 403, 503, 610 the effects of charge buildup can be mitigated.

FIG. 3 diagrams schematically the connection of a surface of the ion generator 303 to the Cathode 306 through a resistor 308.

In one non-limiting aspect of the disclosure for a vehicle application, as in FIG. 4, a straightforward connection 415 of the conductive surface 407 through the resistor 414 to the cathode 403.

In one non-limiting aspect of the disclosure for a table-top, floor-model, or commercial models, a similar conductive path is provided as diagrammed in FIGS. 5 and 6. The table/floor type connects conductive surface 511 through resistor 508 to connection 510 to Cathode 503.

The commercial application illustrated in FIG. 6 can be similar to the above-described aspects. The conductive surface 605 uses connection 606 through resistor 604 to connect with the cathode 610.

In aspects of the disclosure described herein, one or more separate resistors can be omitted since the conductive surface itself could be resistive.

Ion confinement can also be mitigated by providing a path for current to flow back to the respective cathode 102, 306, 403, 503, 610 after flowing through the space to be treated with ions. The path can include existing conductive or semi-conductive materials like water pipes, floors, or the like. In this aspect, the connection can exist between the system cathode 102, 306, 403, 503, 610 to those conductive materials. In FIG. 3, the cathode 306 connection is shown schematically as resistor 308 connected to Earth ground 301.

In the case of application to a vehicle, such as in the aspects of FIG. 4, the electrical ground is replaced by vehicle ground 412. As further shown in FIG. 4, the cathode 403 is connected by a series of connections 404, through internal circuitry 408, a power connection 405, through the power socket 410, to vehicle ground 412. Aspects of the disclosure can include a subset of the aforementioned connections, or additional connections.

In case of a table model or floor model, as shown in FIG. 5 the cathode 503 can be connected by way of connection 510 through power lead 509 to power supply 512, where the isolation transformer 516 includes a resistor 513, to allow connection to building wiring 514. In the case where an electrical ground connection is included (for example, with a grounded power connection), a direct connection can be made instead of a resistor across the isolation transformer. Aspects of the disclosure can include a subset of the aforementioned connections, or additional connections.

The direct connection can also be included in the embodiments of commercial applications, for example, as shown in FIG. 6. In FIG. 6, the cathode 610 is connected directly to electrical ground 601. In cases where are larger area is to be treated with ions, or where the building does not inherently include grounded features, and additional plate or screen 613 can be provided. This could be, for example, a wire mesh in the ceiling above a livestock barn or, a conductive floor in a hospital room.

Many other possible embodiments and configurations in addition to that shown in the above figures are contemplated by the present disclosure To the extent not already described, the different features and structures of the various embodiments can be used in combination with each other as desired. That one feature cannot be illustrated in all of the embodiments is not meant to be construed that it cannot be, but is done for brevity of description. Thus, the various features of the different embodiments can be mixed and matched as desired to form new embodiments, whether or not the new embodiments are expressly described. Combinations or permutations of features described herein are covered by this disclosure.

This written description uses examples to disclose embodiments of the invention, including the best mode, and also to enable any person skilled in the art to practice embodiments of the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An ion generating device comprising:

a housing with at least one conductive surface and an opening;

an anode and a cathode disposed within the housing and having a space between them in fluid communication with the opening, and wherein the cathode is physically spaced from the at least one conductive surface;

a power source having a negative terminal and a positive terminal with a first connection between the negative terminal and the anode and a second connection between the positive terminal and the cathode;

an air mover disposed to direct air through the space toward the at least one conductive surface; and a resistive element connected to the second connection and associated with the at least one conductive surface wherein when the power source is energized, an electrical field with negative ions is generated in the space and the negative ions are directed through the opening by the air mover with minimal charge build up.

2. The ion generating device of claim 1 further comprising a resistor connected between the second connection and ground for minimal ion confinement.

3. The ion generating device of claim 1 further comprising a current-limiting resistive element in the first connection.

4. The ion generating device of claim 1 wherein the power source is a high voltage power supply.

5. The ion generating device of claim 4 wherein the high voltage power supply is external to the housing.

6. The ion generating device of claim 1 wherein the at least one conductive surface is external to the housing.

7. The ion generating device of claim 1 wherein the at least one conductive surface is internal to the housing.

8. The ion generating device of claim 1 wherein a ground is one of a mains power, a surface of the ion generating device, a plate, a screen, a mesh, or a surface of an enclosed space within the ion generating device is disposed.

9. An ion generating device comprising:

a housing with at least one conductive surface and an opening;

an air mover disposed to direct air;

an anode and a cathode disposed within the housing and having a space between them in fluid communication with the opening, and wherein the cathode is physically spaced from the at least one conductive surface;

a power source having a negative terminal and a positive terminal with a first connection between the negative terminal and the anode and a second connection between the positive terminal and the cathode; and a resistive element connected to the second connection and associated with the at least one conductive surface wherein when the power source is energized, an electrical field with negative ions is generated in the space and the negative ions are directed through the opening by the air mover with minimal charge build up;

wherein the arrangement of the air mover relative to the anode, cathode, and at least one conductive surface is configured to direct air sequentially from the air mover, through the space, and downstream to the at least one conductive surface.

* * * * *